United States Patent [19]

O'Dell

[11] Patent Number: 4,848,000

[45] Date of Patent: Jul. 18, 1989

[54] SHEATH FOR PIVOTABLE KNIVES

[76] Inventor: Douglas O'Dell, Route #1, Box 5, Yorktown, Ind. 47396

[21] Appl. No.: 161,489

[22] Filed: Feb. 29, 1988

[51] Int. Cl.[4] ..... B26B 29/02

[52] U.S. Cl. ..... 30/158; 30/143; 224/232

[58] Field of Search ..... 30/138, 158, 159, 160, 30/151, 155, 143; 224/232

[56] References Cited

U.S. PATENT DOCUMENTS

| | | | |
|---|---|---|---|
| 4,389,775 | 6/1983 | Collins | 30/151 X |
| 4,426,779 | 1/1984 | Morgan | 30/158 X |
| 4,466,561 | 8/1984 | Slaughter | 30/155 X |
| 4,494,310 | 1/1985 | Slaughter | 30/155 |
| 4,561,577 | 12/1985 | Moore | 224/232 |

*Primary Examiner*—Frank T. Yost
*Assistant Examiner*—Michael D. Folkerts
*Attorney, Agent, or Firm*—Baker & Daniels

[57] ABSTRACT

Knife sheath for pivotable knives such that a knife blade is automatically extended as the knife is removed from the sheath. The sheath has front and back faces with connected edges, but having two opposing first and second separated edge areas so that the knife blade may be simultaneously inserted through both separations. After a knife is inserted into the sheath through the separations, the knife is pivoted to enclose the blade in the sheath. As the knife is removed from the sheath, a connecting member adjacent to the upper edge separation causes the blade to extend.

10 Claims, 4 Drawing Sheets

SHEATH FOR PIVOTABLE KNIVES

FIELD OF THE INVENTION

This invention relates to sheaths for knives, and in particular, sheaths that allow a pivotable knife blade to be opened as the knife is removed from the sheath.

BACKGROUND OF THE INVENTION

Pivotable knives have blades, the sharp edges of which engage the knife handle when in a closed position. Users of such knives are prone to place their fingers or hands between the blade and the blade engaging portion of the handle when opening or closing the knife blade. Such action increases the likelihood of accidentally cutting one's hands while pivoting the knife blade. Therefore, it is desirable to create a sheath in which the knife may be kept that will automatically retract and extend the knife blade as the knife is inserted and removed, respectively. Furthermore it is desirable to design a sheath that will automatically extend a knife blade without having to rotate the knife handle, as such action necessarily causes a person to grasp the knife handle with an unnatural and dangerous grip.

Prior art sheaths include those described in U.S. Pat. Nos. 4,466,561, 4,494,310, 4,389,775.

OBJECTS OF THE INVENTION

One object of the invention is to provide a knife sheath which allows a knife blade to be extended upon removing the knife from the sheath, and retracted upon inserting the knife into the sheath.

Another object of the invention is to provide a knife sheath which allows the knife handle to be fully grasped when removing the knife from the sheath.

Another object of the invention is to provide a knife sheath which allows the knife to be removed by pulling the knife in a straight line, rather than by rotating the knife with respect to its blade.

Still other objects and advantages of the invention will become apparent to those of skill in the art after reading the following description of a preferred embodiment.

SUMMARY OF THE INVENTION

The invention comprises a knife sheath for pivotable knives such that a knife blade is automatically extended as the knife is removed from the sheath, and is automatically retracted as the knife is inserted into the sheath. The sheath has front and back faces with connected edges, but having two opposing first and second separated edge areas so that the knife blade may be simultaneously inserted through both separations. After a knife is inserted into the sheath through the separations, the knife is pivoted to enclose the blade in the sheath. As the knife is removed from the sheath, a face connecting member adjacent to the upper edge separation causes the blade to extend.

DETAILED DESCRIPTION OF THE PRESENT INVENTION

Figure 1:
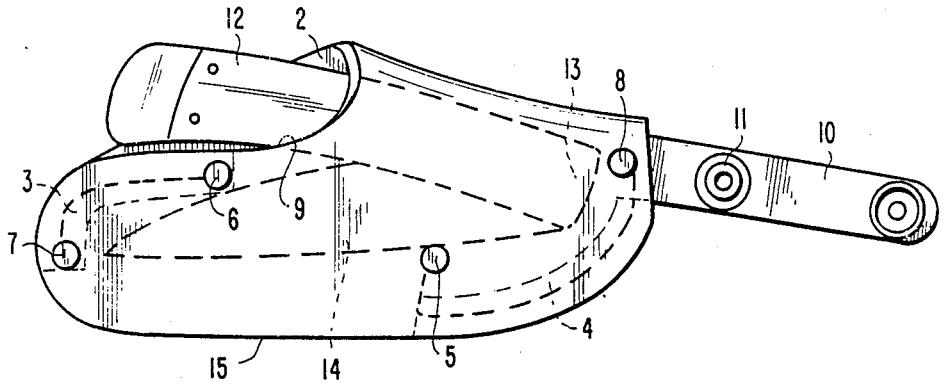
FIG. 1 is a view of a knife fully enclosed in the sheath of the invention.

FIG. 1 is a view of a knife fully enclosed in the sheath of the invention. The sheath is comprised of front face 1 and back face 2. In the preferred embodiment, these faces are integral, having a common folded upper edge 17, and are made of leather approximately ⅛" (3.5 mm.) thick. The upper edges of faces 1 and 2 are also joined by stitching 3, except for separated area 9, through which knife handle 12 extends. Faces 1 and 2 are further joined along their bottom edges by stitching 4. There is also a separation 15 along the bottom edge of the faces. To provide durability, stitched section 3 is bounded on either side by rivets 6 and 7, and stitched section 4 is bounded by rivets 5 and 8. Also, in the preferred embodiment, stitched sections 3 and 5 have narrow strips of leather, also ⅛" (3.5 mm.) thick, between the front and back faces, to provide extra space between said faces.

Also, belt loop attachment 10 is secured to the sheath by rivet 8, and includes snap 11, so that the sheath may be attached to a belt loop.

Figure 2:
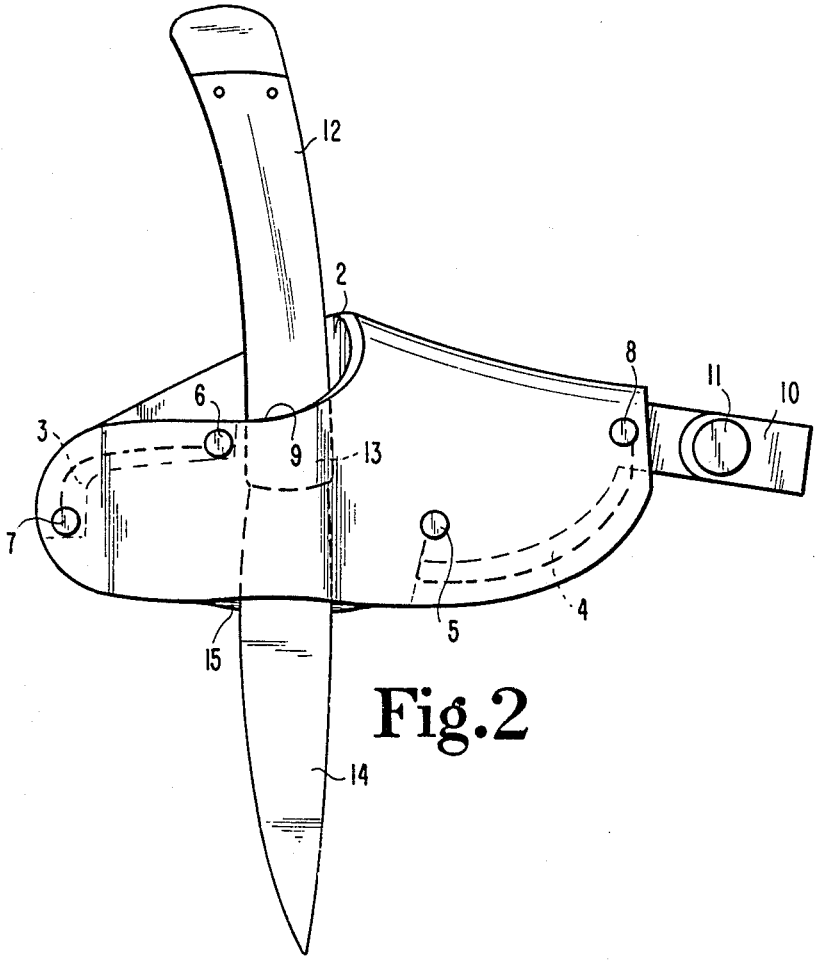
FIG. 2 is a view of the first step in inserting a knife into the sheath.

FIG. 2 is a view of the first step in inserting a knife into the sheath. A fully extended knife is inserted through top separation 2 and bottom separation 15 so that its blade pivot pin 13 is in the sheath. FIG. 2 also shows the belt loop attachment 10 in a snapped position.

Figure 3:
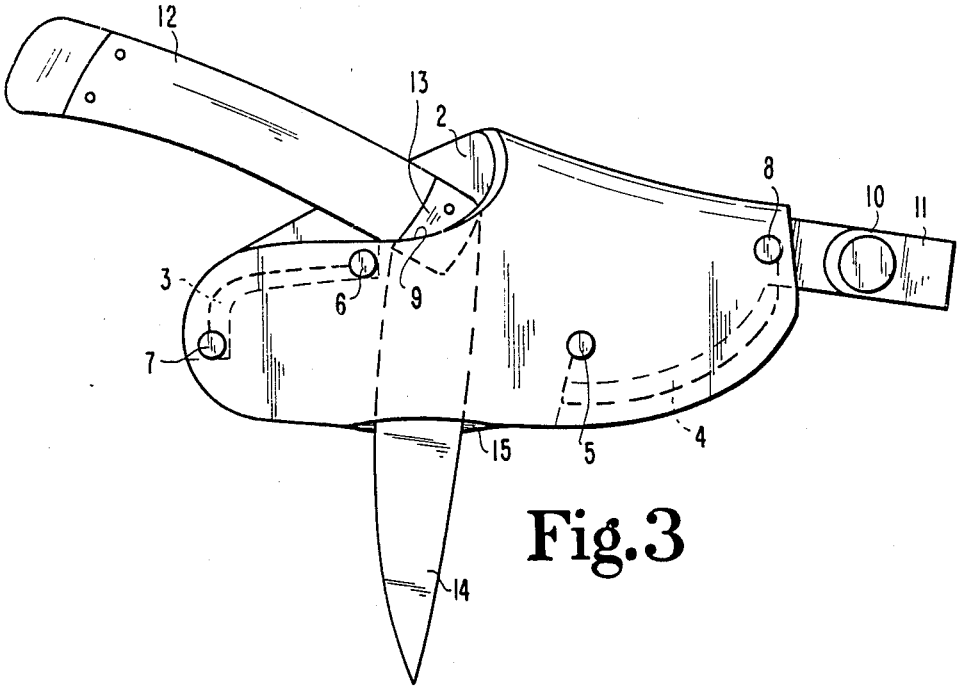
FIG. 3 is a view showing the second step in inserting a knife into the sheath, rotating the knife handle.

FIG. 3 is a view showing the second step, in inserting a knife into the sheath, rotating the knife handle. After the knife has been inserted into the sheath as shown in FIG. 2, its handle 12 is rotated toward its blade 14. Rivet 5, which acts as lower edge connecting member, prevents blade 14 from remaining straight as handle 12 is rotated.

Once handle 12 is rotated to approximately horizontal position, it is pushed into the sheath into the position shown in FIG. 1. As it is pushed, rivet 5 causes blade 14 to retract into the sheath. Rivet 6, which serves as an upper edge connecting member, prevents blade 14 from fully retracting into the handle 12. Although rivet 6 is referred to as a "connecting member" in this specification, any member which prevents the full retraction of blade 14 into handle 12 is contemplated by the invention even if the member is not "connected" to both faces of the sheath.

It is contemplated that the upper and lower edge connecting members, 6 and 5, may comprise stitching or even be integrally formed by front and back faces, 1 and 2. However, it is recommended that these members be sufficiently durable so that they do not become worn from repeated insertions and retractions of a knife.

Figure 4:
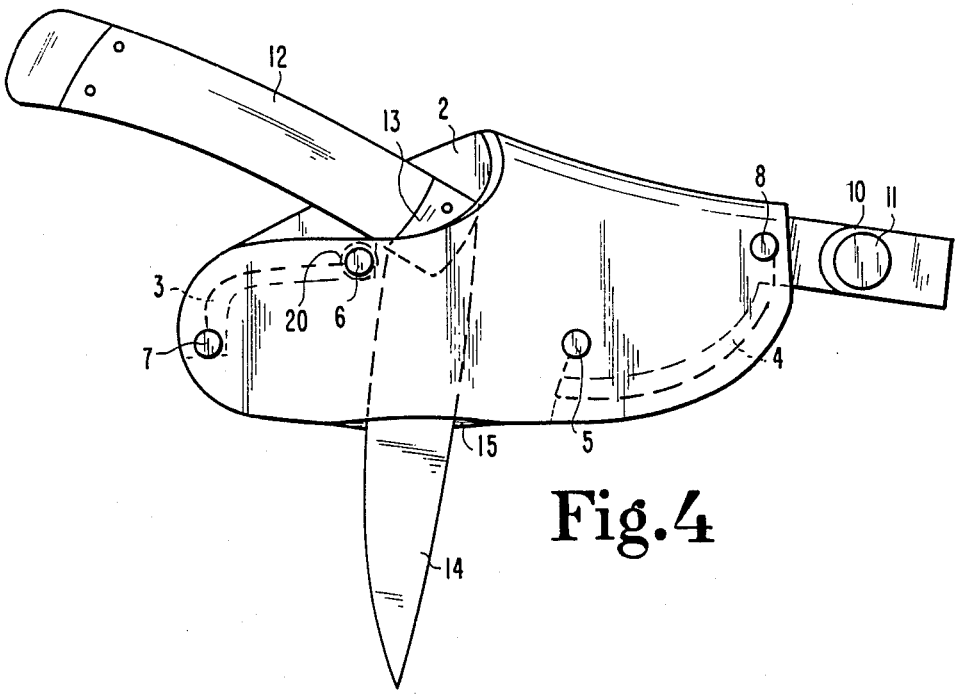
FIG. 4 is a view showing the how a first connection member in the upper edge of the sheath causes the blade to extend when the knife is removed from the sheath.

FIG. 4 is a view showing the how the upper edge connection member of the sheath causes the blade to extend when the knife is removed from the sheath. As handle 12 is pulled horizontally out of the sheath, rivet 6 forces blade 14 to open. In the preferred embodiment, washer 20 may be placed around rivet 6 and between faces 1 and 2 to reduce the likelihood that the inner faces will be cut when a knife is extracted.

It may also be appreciated from FIG. 4 that the entire circumference of handle 12 may be grasped to pull the knife from the sheath. This is a significant advantage of the present invention over prior art devices, which do not allow the handle to be grasped at the point where the blade engages the handle.

Figure 5:
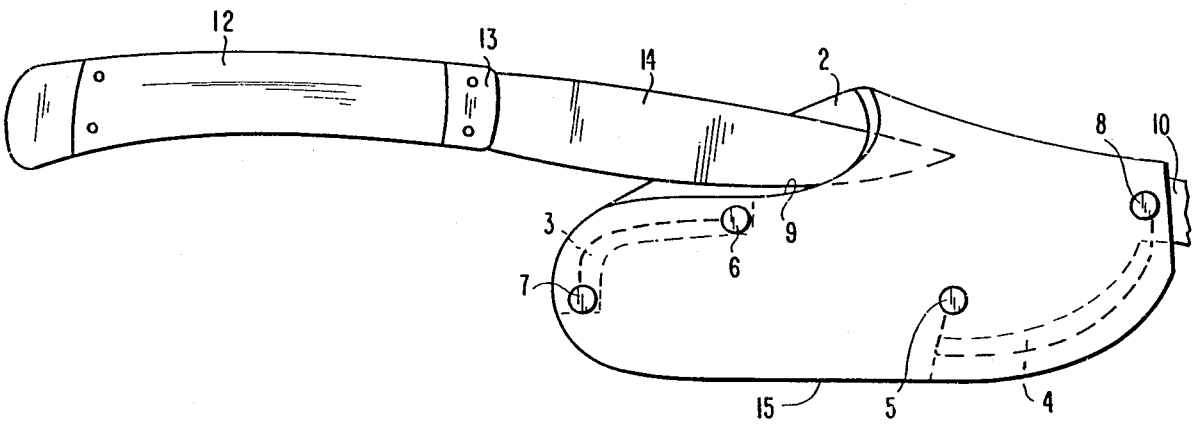
FIG. 5 is a view showing how the blade of a knife is fully extended when removed from the sheath.

FIG. 5 is a view showing how the blade of a knife is fully extended when removed from the sheath. Also in FIG. 4, rivet 6 continues to force extension of blade 14 as handle 12 is pulled from the sheath.

Figure 6:
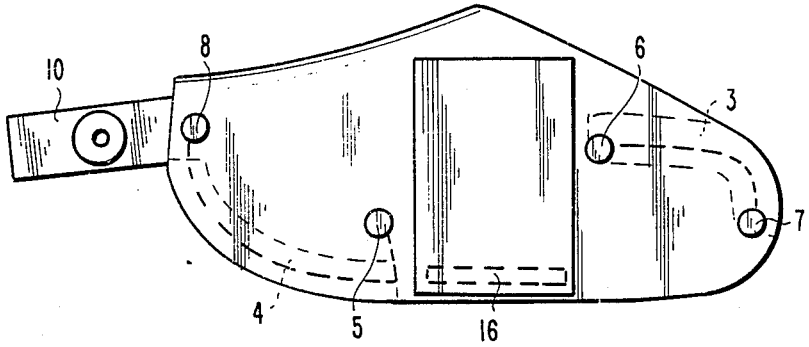
FIG. 6 is a view of the back of the sheath showing a belt loop which may be used to attach the sheath to a belt.

FIG. 6 is a view of the back of the sheath showing a belt loop which may be used to attach the heat to a belt. In addition to belt loop attachment 10 described above, a belt may also be inserted between back face 2 and belt loop 16. The lower end of belt loop 16 is stitched to the boottom edge, and the top edge is turned over and stitched (not shown) to the middle of back face 2. Belt loop 16 allows the sheath to be worn in a horizontal position as shown in FIGS. 1 through 6. If belt loop attachment 10 is used, then the sheath hangs in a vertical position. Alternatively, belt loop 16 may be secured to back face 2 in a position rotated ninety degrees from that shown in FIG. 6, to allow the sheath to be worn in a vertical position.

The principles, preferred embodiment and modes of operation of the present invention have been described in the foregoing specification. The invention is not to be construed as limited to the particular forms disclosed, since they are regarded as illustrative rather than restrictive. Moreover, variations and changes may be made by those skilled in the art without departing from the spirit of the invention.

I claim:

1. A knife sheath for pivotable knives comprising:

a front face and back face, each of said faces having an upper edge and a lower edge;

said faces being connected along a portion of their upper edge, and separated along a portion of their upper edges;

said faces being connected along a portion of their lower edges, and separated along a portion of their lower edges, such that a knife blade may be inserted through the upper edge separation, between the faces and through the lower edge separation;

an upper edge connecting member joining the upper face edges adjacent to the upper edge separation;

a lower edge connecting member joining the lower face edges adjacent to the lower edge separation;

whereby the blade of a pivotable knife cooperates with the upper edge connecting member and is extended upon removal from the sheath; and whereby the lower edge connecting member cooperates with the blade of a pivotable knife to pivot the blade upon insertion of the knife into the sheath.

2. The knife sheath for pivotable knives of claim 1 wherein the front and back faces are integrally formed.

3. The knife sheath of claim 1 wherein said connecting members are comprised of rivets.

4. The knife sheath of claim 3 further comprising a washer located around the upper edge connecting rivet and between the front and back faces.

5. The knife sheath of claim 1 further comprising a belt loop attached to the outside of the back face.

6. A knife and knife sheath comprising:

a knife having a pivotable blade, the sharp edge of which may be retracted into the knife handle;

a sheath with front and back faces and upper and lower edges, said faces being connected at their edges but having opposing first and second separated edge areas, such that the knife blade may be simultaneously inserted through both separations;

a connecting member adjacent said second separated edge area, which, when the knife blade has been inserted between the separations, cooperates with the blade to cause the knife blade to pivot when the knife handle is rotated toward said first separated edge;

a connecting member adjacent said first separated edge area, which prevents the knife blade from fully retracting into the handle when the knife handle is rotated toward said first separated edge and which causes the knife blade to extend to an open position when the knife handle is retracted from said first separated edge.

7. The knife and sheath of claim 6 wherein the front and back faces are integrally formed.

8. The knife and sheath of claim 6 wherein said connecting members are comprised of rivets.

9. The knife and sheath of claim 8 further comprising a washer located around the upper edge connecting rivet and between the front and back faces.

10. The knife sheath of claim 6 further comprising a belt loop attached to the outside of the back face.

* * * * *